US010885844B2

(12) United States Patent
Koh

(10) Patent No.: US 10,885,844 B2
(45) Date of Patent: Jan. 5, 2021

(54) PIXEL, DISPLAY DEVICE INCLUDING THE SAME AND METHOD THEREOF

(71) Applicant: SAMSUNG DISPLAY CO., LTD., Yongin-si (KR)

(72) Inventor: Byung-Sik Koh, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/703,274

(22) Filed: Sep. 13, 2017

(65) Prior Publication Data

US 2018/0012548 A1 Jan. 11, 2018

Related U.S. Application Data

(62) Division of application No. 14/051,807, filed on Oct. 11, 2013, now abandoned.

(30) Foreign Application Priority Data

Feb. 25, 2013 (KR) ..... 10-2013-0019947

(51) Int. Cl.
*G09G 3/3258* (2016.01)

(52) U.S. Cl.
CPC ... *G09G 3/3258* (2013.01); *G09G 2300/0465* (2013.01); *G09G 2310/0251* (2013.01); *G09G 2310/0262* (2013.01); *G09G 2310/061* (2013.01); *G09G 2310/063* (2013.01); *G09G 2320/045* (2013.01)

(58) Field of Classification Search
CPC ... G09G 2300/0465; G09G 2310/0251; G09G 2310/0262; G09G 2310/061; G09G 2310/063; G09G 2320/045; G09G 3/3258
See application file for complete search history.

(56) References Cited

U.S. PATENT DOCUMENTS

| | | | |
|---|---|---|---|
| 7,079,101 | B1 | 7/2006 | Asada |
| 2006/0044236 | A1 | 3/2006 | Kim |
| 2007/0146247 | A1 | 6/2007 | Huang et al. |

(Continued)

FOREIGN PATENT DOCUMENTS

| | | | |
|---|---|---|---|
| CN | 1741110 | A | 3/2006 |
| CN | 1881397 | A | 12/2006 |

(Continued)

*Primary Examiner* — LaTanya Bibbins
(74) *Attorney, Agent, or Firm* — Lewis Roca Rothgerber Christie LLP

(57) ABSTRACT

A pixel may include a switching transistor connected to a data line and a first node, having a gate electrode connected to a scan line, a sustain transistor connected to a sustain voltage and the first node, having a gate electrode connected to the scan line, a storage capacitor connected to the first node and the second node, a driving transistor connected to the first power source voltage and a third node, having a gate electrode connected to the second node, a compensation transistor connected to the second node and the third node, having a gate electrode connected to a control line, a reset transistor connected to an initializing voltage and the second node, having a gate electrode connected to a reset control line, and an organic light emitting diode including an anode connected to the third node and a cathode connected to the second power source voltage.

13 Claims, 9 Drawing Sheets

(56) References Cited

U.S. PATENT DOCUMENTS

| | | | | |
|---|---|---|---|---|
| 2008/0158205 | A1* | 7/2008 | Park | G09G 3/3225 345/204 |
| 2009/0256785 | A1* | 10/2009 | Sung | G09G 3/3258 345/77 |
| 2010/0053141 | A1* | 3/2010 | Ishiguro | G09G 3/3233 345/211 |
| 2011/0193855 | A1* | 8/2011 | Han | G09G 3/3233 345/214 |
| 2011/0273428 | A1* | 11/2011 | Han | G09G 3/3233 345/212 |
| 2011/0279484 | A1* | 11/2011 | Han | G09G 3/3233 345/690 |

FOREIGN PATENT DOCUMENTS

| | | | |
|---|---|---|---|
| CN | 101739955 | A | 6/2010 |
| EP | 1 635 324 | A1 | 3/2006 |
| KR | 10-0624137 | B1 | 9/2006 |
| KR | 10-2011-0091293 | | 8/2011 |
| KR | 10-1073281 | B1 | 10/2011 |
| KR | 10-2012-0014718 | A | 2/2012 |
| KR | 10-1210029 | B1 | 12/2012 |
| TW | 201248590 | A | 12/2012 |
| WO | WO 2006/013539 | A1 | 2/2006 |

* cited by examiner

PIXEL, DISPLAY DEVICE INCLUDING THE SAME AND METHOD THEREOF

CROSS-REFERENCE TO RELATED APPLICATIONS

This is a divisional application based on pending application Ser. No. 14/051,807, filed Oct. 11, 2013, the entire contents of which is hereby incorporated by reference.

Korean Patent Application No. 10-2013-0019947, filed on Feb. 25, 2013, in the Korean Intellectual Property Office, and entitled: "Pixel, Display Device Including the Same and Method Thereof," is incorporated by reference herein in its entirety.

BACKGROUND

1. Field

Embodiments relate to a pixel, a display device including the same and a driving method thereof and, more particularly, to an active matrix type organic light emitting diode (OLED) display, and a driving method thereof.

2. Description of the Related Art

An organic light emitting diode (OLED) display uses an organic light emitting diode (OLED) in which the luminance is controlled by a current or voltage. The organic light emitting diode (OLED) includes an anode layer and cathode layer forming an electric field, and an organic light emitting material that emits light due to the electric field.

Typically, the organic light emitting diode (OLED) display is classified into a passive matrix type OLED (PMOLED) and an active matrix type OLED (AMOLED), depending on a mode for driving the organic light emitting diode (OLED). Among these, the AMOLED, which selects individual unit pixels to emit light, is mainly used in terms of a resolution, a contrast, and an operation speed.

A pixel of an active matrix type OLED includes an organic light emitting diode (OLED), a driving transistor to control an amount of the current supplied to the organic light emitting diode (OLED), and a switching transistor to transmit a data signal controlling an amount of light emitting of the organic light emitting diode (OLED) to the driving transistor.

Recently, larger sized and higher resolution organic light emitting diode (OLED) displays have been required. Such organic light emitting diode (OLED) displays should be able to perform a high-speed driving capable of inputting data signals to the larger display panel, reducing the number of the transistors configured of the pixel, and increasing the aperture ratio thereof. Therefore, pixels thereof are required to enable the high-speed driving of the display device and to increase the aperture ratio.

The above information disclosed in this Background section is only for enhancement of understanding of the background of the disclosure and therefore it may contain information that does not form the prior art that is already known in this country to a person of ordinary skill in the art.

SUMMARY

One or more embodiments are directed to providing a pixel that may include a switching transistor including a gate electrode connected to a scan line, a first electrode connected to a data line, and a second electrode connected to a first node, a sustain transistor including a gate electrode connected to the scan line, a first electrode connected to a sustain voltage, and a second electrode connected to the first node, a storage capacitor including a first electrode connected to the first node and a second electrode connected to a second node, a driving transistor including a gate electrode connected to the second node, a first electrode connected to a first power source voltage, and a second electrode connected to a third node, a compensation transistor including a gate electrode connected to a control line, a first electrode connected to the second node, and a second electrode connected to the third node, a reset transistor including a gate electrode connected to a reset control line, a first electrode connected to an initializing voltage, and a second electrode connected to the second node, and an organic light emitting diode including an anode connected to the third node, and a cathode connected to a second power source voltage.

The control line may be a compensation control line.

The switching transistor may be an n-channel field effect transistor and the sustain transistor may be a p-channel field effect transistor.

The driving transistor may be a p-channel field effect transistor and the compensation transistor and the reset transistor may be n-channel field effect transistors.

At least one of the switching transistor, the sustain transistor, the driving transistor, the compensation transistor, and the reset transistor may be an oxide thin film transistor.

The scan line may serve as the control line.

One or more embodiments are directed to providing a display device that may include a plurality of pixels, a scan driver to apply a scan signal to a plurality of scan lines connected to the plurality of pixels, a data driver to apply a data signal to a plurality of data lines connected to the plurality of pixels in response to the scan signal, and a power supply unit to supply a first power source voltage, a second power source voltage, a sustain voltage and an initializing voltage to the plurality of pixels and to control a light emitting of the plurality of pixels by changing the second power source voltage. Each of the plurality of pixels may include a switching transistor including a gate electrode connected to a respective scan line, a first electrode connected to a respective, and a second electrode connected to a first node, a sustain transistor including a gate electrode connected to the respective scan line, a first electrode connected to the sustain voltage, and a second electrode connected to the first node, a storage capacitor including a first electrode connected to the first node and a second electrode connected to a second node, a driving transistor including a gate electrode connected to the second node, a first electrode connected to the first power source voltage, and a second electrode connected to a third node, a compensation transistor including a gate electrode connected to one of a plurality of control lines connected to the plurality of pixels, a first electrode connected to the second node, and a second electrode connected to the third node, a reset transistor including a gate electrode connected to a respective reset control line connected to the plurality of pixels, a first electrode connected to the initializing voltage, and a second electrode connected to the second node, and an organic light emitting diode including an anode connected to the third node and a cathode connected to the second power source voltage.

The plurality of control lines may be a plurality of compensation control lines.

The switching transistor may be an n-channel field effect transistor and the sustain transistor may be a p-channel field effect transistor.

The driving transistor may be a p-channel field effect transistor, and the compensation transistor and the reset transistor may be n-channel field effect transistors.

At least one of the switching transistor, the sustain transistor, the driving transistor, the compensation transistor, and the reset transistor may be an oxide thin film transistor.

The plurality of scan lines may serve as the plurality of control lines.

One or more embodiments are directed to providing a driving method of a display device that includes a plurality of pixels including a first node to which a data voltage is applied through a switching transistor turned-on by a scan signal of a gate-on voltage and to which a sustain voltage is applied through a sustain transistor turned-on by a scan signal of a gate off voltage, a second node connected to a gate electrode of a driving transistor that controls a driving current transmitted to an organic light emitting diode from a first power source voltage, and a storage capacitor connected between the first node and the second node. The driving method may include applying a reset control signal of a gate-on voltage to a gate electrode of a reset transistor that transmits an initializing voltage to the second node such that a voltage of the second node is reset to the an initializing voltage, turning on a compensation transistor that diode-connects the driving transistor such that a threshold voltage of the driving transistor is compensated, turning on the switching transistor by a scan signal of the gate-on voltage such that the data voltage is applied to the first node, turning on the sustain transistor by a scan signal of the gate off voltage such that a voltage of the first node is changed from the data voltage to the sustain voltage, applying a voltage to which the data voltage is reflected through a coupling by the storage capacitor, and changing a second power source voltage connected to a cathode of the organic light emitting diode and turning on the driving transistor according to a voltage of a second node to which the data voltage is reflected such that the organic light emitting diode emits light.

Compensating the threshold voltage of the driving transistor and applying the data voltage to the first node may be performed at the same time.

Resetting the voltage of the second node to the initializing voltage may include sequentially applying a reset control signal of the gate-on voltage to a plurality of reset control lines connected to the plurality of pixels.

Resetting the voltage of the second node to the initializing voltage may include applying a reset control signal of the gate-on voltage to a plurality of reset control lines connected to the plurality of pixels at the same time.

Compensating the threshold voltage of the driving transistor may include sequentially applying a compensation control signal of a gate-on voltage for turning on the compensation transistor to a plurality of compensation control lines connected to the plurality of pixels.

Compensating the threshold voltage of the driving transistor may include applying a scan signal of the gate-on voltage to a plurality of scan lines connected to the plurality of pixels and turning on the compensation transistor by a scan signal of the gate-on voltage.

Compensating a threshold voltage of the driving transistor may include the step of sequentially applying a scan signal of the gate-on voltage to a plurality of scan lines connected to the plurality of pixels and turning on the compensation transistor by a scan signal of the gate-on voltage.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
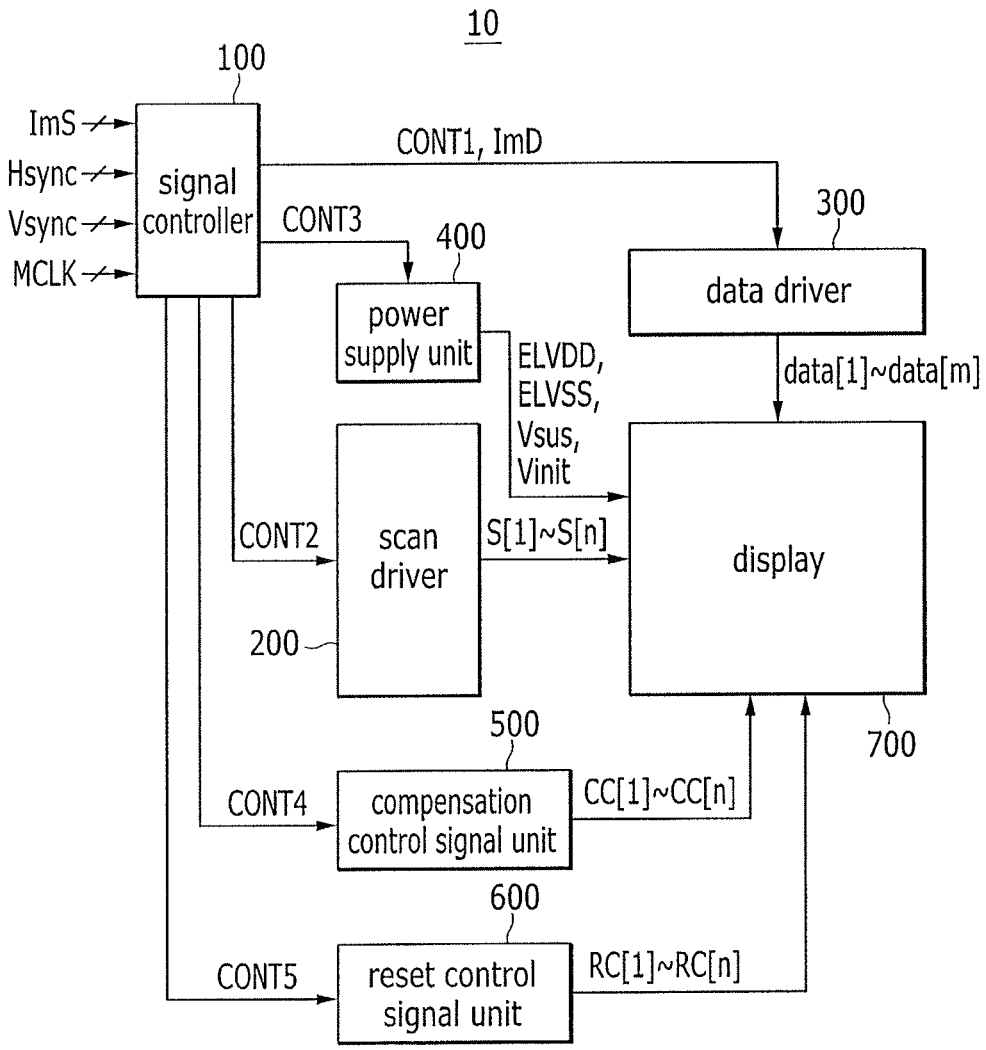
FIG. 1 illustrates a block diagram of a display device according to an exemplary embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In addition, in various exemplary embodiments, the first exemplary embodiment is described as a representative in which the same reference numerals are used in components with the same configuration, and other embodiments different from the first exemplary embodiment will only be described only are used.

In order to clearly explain the embodiments, the portions regarded as illustrative in nature will be omitted, and the same reference numerals are used to denote the same component throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising," will be understood to imply the inclusion of stated elements but not the exclusion of any other elements.

FIG. 1 illustrates a block diagram of a display device according to an exemplary embodiment. Referring to FIG. 1, a display device 10 includes a signal controller 100, a scan driver 200, a data driver 300, a power supply unit 400, a compensation control signal unit 500, a reset control signal unit 600, and a display 700.

The signal controller 100 receives a video signal ImS and a synchronizing signal input from an external device. The video signal ImS contains luminance information for a plurality of pixels. The luminance may have a fixed number, for example, $1024=2^{10}$, $256=2^{8}$ or $64=2^{6}$ of grayscales (gray). The synchronizing signal may include a horizontal synchronization signal Hsync, a vertical synchronization signal Vsync, and a main clock signal MCLK.

The signal controller 100 may generate first to fifth driving control signals CONT1 to CONT5 and an image data signal ImD according to the video signal ImS, the horizontal synchronization signal Hsync, the vertical synchronization signal Vsync, and the main clock signal MCLK. The signal controller 100 classifies the video signal ImS as a frame unit according to the vertical synchronization signal Vsync and the video signal ImS as a scan line unit according to the horizontal synchronization signal Hsync to generate the image data signal ImD. The signal controller 100 transmits the image data signal ImD to the data driver 300 together with the first driving control signal CONT1.

The display 700 is a display area including a plurality of pixels. The display 700 is formed such that a plurality of scan lines approximately extend in a row direction and almost parallel to each other, a plurality of data lines approximately extend in a column direction and almost parallel to each other, a plurality of power supply lines, the plurality of compensation control lines, and a plurality of reset control line are connected to the plurality of pixels. The plurality of pixels may be arranged in an approximately matrix configuration.

The scan driver 200 is connected to the plurality of scan lines to generate a plurality of scan signals S[1]-S[n] according to the second driving control signal CONT2. The scan driver 200 may sequentially apply scan signals S[1]-S[n] of the gate-on voltage to the plurality of scan lines.

The data driver 300 is connected to the plurality of data lines to hold and sample the image data signal ImD input according to the first driving control signal CONT1 and to transmit the plurality of data signals data[1]-data[m] to each of the plurality of data lines. The data driver 300 applies the data signals data[1]-data[m] having a predetermined voltage range to the plurality of data lines in response to the scan signal (S[1]-S[n]) of the gate-on voltage.

The power supply unit 400 determines levels of a first power source voltage ELVDD and a second power source voltage ELVSS according to the third driving control signal CONT3 to supply them to the plurality of power supply lines connected to the plurality of pixels. The first power source voltage ELVDD and the second power source voltage ELVSS provide a driving current of the pixel. In addition, the power supply unit 400 may supply a sustain voltage Vsus and an initializing voltage Vinit with a predetermined level to the plurality of power supply lines connected to the plurality of pixels.

The compensation control signal unit 500 determines a level of compensation control signals CC[1]-CC[n] according to the fourth driving control signal CONT4 to apply them to the plurality of compensation control lines connected to the plurality of pixels. The compensation control signal unit 500 may sequentially apply the compensation control signals CC[1]-CC[n] of the gate-on voltage to the plurality of compensation control lines.

The reset control signal unit 600 may determine levels of reset control signals RC[1]-RC[n] according to a fifth driving control signal CONT5 and apply them to the plurality of reset control lines connected to the plurality of pixels. The reset control signal unit 600 may sequentially apply the reset control signals RC[1]-RC[n] of the gate-on voltage to the plurality of reset control lines. In addition, the reset control signal unit 600 may simultaneously apply the reset control signal RC[1]-RC[n] of the gate-on voltage to the plurality of reset control lines.

Figure 2:
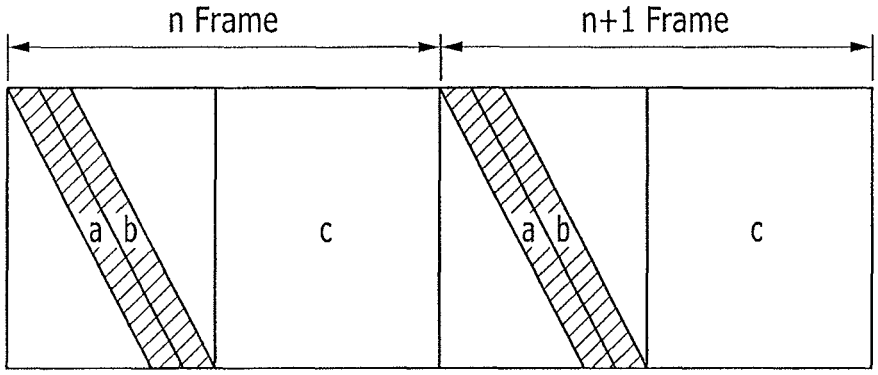
FIG. 2 illustrates a drawing of a driving operation of a simultaneous light emitting mode of a display device according to an exemplary embodiment.

FIG. 2 illustrates a drawing of a driving operation of a simultaneous light emitting mode of a display device according to an exemplary embodiment. Referring to FIG. 2, the display device 10 according to the present embodiment will be described as an organic light emitting diode display using an organic light emitting diode. However, embodiments may be applied to a variety of display devices.

A frame period in which one image is displayed the display 700 includes a reset period (a) to reset the driving voltage of the organic light emitting diode of the pixel, a threshold voltage compensation and scan period (b) in which a threshold voltage of the driving transistor of the pixel is compensated, and the data signal is transmitted to each of the plurality of pixels, and a light emitting period (c) in which the plurality of pixels emit light in response to the transmitted data signal.

The operation in the reset period (a) and the threshold voltage compensation and scan period (b) may be sequentially performed for each scan line. The operation in the light emitting period (c) may be simultaneously performed for the entirety of the display 700.

Figure 3:
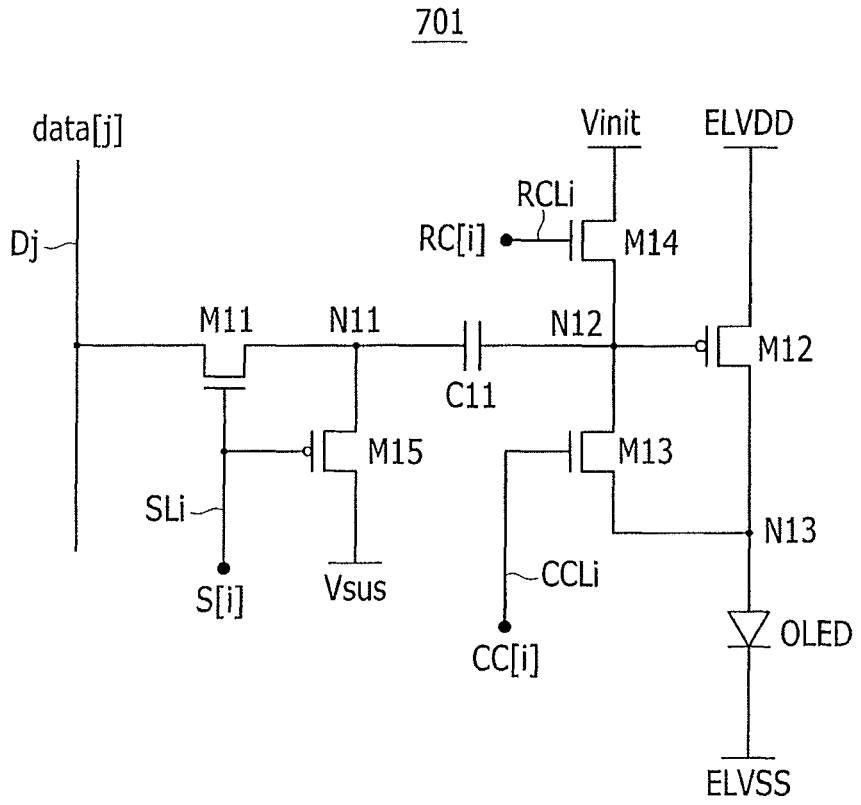
FIG. 3 illustrates a circuit diagram of a pixel according to an exemplary embodiment.

FIG. 3 illustrates a circuit diagram of an example of a pixel according to an exemplary embodiment. A pixel is shown that is any one of the plurality of pixels included in the display device 10 of FIG. 1.

Referring to FIG. 3, the pixel 701 includes a switching transistor M11, a driving transistor M12, a compensation transistor M13, a reset transistor M14, a sustain transistor M15, a storage capacitor C11, and an organic light emitting diode (OLED).

The switching transistor M11 includes a gate electrode connected to a scan line SLi, a first electrode connected to a data line Dj, and a second electrode connected to a first node N11. The switching transistor M11 is turned on by a scan signal S[i] of the gate-on voltage applied to the scan line SLi to transmit a data signal data[j] applied to the data line Dj to the first node N11. The switching transistor M11 is an n-channel field effect transistor.

The gate-on voltage to turn on the n-channel field effect transistor is a high level voltage, and the gate off voltage to turn-off the n-channel field effect transistor is a low level voltage. Hereinafter, the scan signal S[i] of the gate-on voltage is a high level voltage and the scan signal S[i] of the gate off voltage is a low level voltage.

The driving transistor M12 includes a gate electrode connected to a second node N12, a first electrode connected to the first power source voltage ELVDD, and a second electrode connected to a third node N13. The third node N13 is connected to an anode of the organic light emitting diode (OLED). The driving transistor M12 controls the driving current supplied from the first power source voltage ELVDD to the organic light emitting diode (OLED) according to the voltage of the second node N12. Here, the driving transistor M12 is a p-channel field effect transistor.

The compensation transistor M13 includes a gate electrode connected to a compensation control line CCLi, a first electrode connected to the second node N12, and a second electrode connected to the third node N13. The compensation transistor M13 is turned on by a compensation control signal CC[i] of the gate-on voltage applied to the compensation control line CCLi to diode-connect the driving transistor M12. Here, the compensation transistor M13 is an n-channel field effect transistor.

The reset transistor M14 includes a gate electrode connected a reset control line RCLi, a first electrode to which the initializing voltage Vinit is applied, and a second electrode connected to the second node N12. The reset transistor M14 is turned on by a reset control signal RC[i] of the gate-on voltage applied to the reset control line RCLi to transmit the initializing voltage Vinit to the second node N12. Here, the reset transistor M14 is an n-channel field effect transistor.

The sustain transistor M15 includes a gate electrode connected to scan line SLi, a first electrode connected to the sustain voltage Vsus, and a second electrode connected to the first node N11. Here, the sustain transistor M15 is a p-channel field effect transistor.

The gate-on voltage to turn on the p-channel field effect transistor is a low level voltage and the gate off voltage to turn-off the p-channel field effect transistor is a high level voltage. The sustain transistor M15 is turned on by the scan signal S[i] of the gate off voltage applied to the scan line SLi, that is, a low level voltage to transmit the sustain voltage Vsus to the first node N11.

The storage capacitor C11 includes a first electrode connected to the first node N11 and a second electrode connected to the second node N12.

The organic light emitting diode (OLED) includes an anode connected to the third node N13 and a cathode connected to the second power source voltage ELVSS. The organic light emitting diode (OLED) includes an organic emission layer to emit light in one of the primary colors. For example, the primary color may be a red, a green and a blue, and the desired color can be displayed by a spatial or temporal sum of the three primary colors.

The organic emission layer can be made of a low molecular organic material or a polymeric organic material such as Poly 3,4-ethylenedioxythiophene (PEDOT). In addition, the organic emission layer may be formed of a multilayer including at least one of an emission layer, a hole injection layer HIL, a hole transport layer HTL, an electron transport layer ETL and an electron injection layer EIL. When all of these layers are included, the hole injection layer HIL is on the pixel electrode of an anode, a hole transport layer HTL, an emission layer, an electron transport layer ETL, and an electron injection layer EIL are sequentially stacked on the hole injection layer HIL.

The organic emission layer may include a red organic emission layer to light-emit a red, a green organic emission layer to light-emit a green, and a blue organic emission layer to light-emit a blue wherein the red organic emission layer, the green organic emission layer and the blue organic emission layer may be formed in a red pixel, a green pixel and a blue pixel, respectively, to realize color images.

In addition, the organic emission layer can be stacked together with the red organic emission layer, the green organic emission layer and the blue organic emission layer in the red pixel, the green pixel, and the blue pixel to form a red color filter, a green color filter, and a blue color filter for each pixel and to implement color images. As another example, a white organic emission layer to emit white light can be formed in all of the red pixel, the green pixel and the blue pixel to form the red color filter, the green color filter and the blue color filter for each pixel, respectively, and to realize color images. When the color image is implemented using the white organic emission layer and the color filter, the red organic emission layer, the green organic emission layer, and the blue organic emission layer are not required, eliminating use of a deposition mask to deposit respective layers for each pixel, i.e., the red pixel, the green pixel, and the blue pixel.

The white organic emission layer described in another example may be formed of one organic emission layer and may include a configuration to emit white light by the plurality of organic emission layers. For example, a configuration to emit white light by combining at least one yellow organic emission layer and at least one blue organic emission layer, a configuration to emit white light by combining at least one cyan organic emission layer and at least one red organic emission layer, and a configuration to emit white light by combining at least one magenta organic emission layer and at least one green organic emission layer may also be included.

As described above, the switching transistor M11, the compensation transistor M13, and the reset transistor M14 are shown as a n-channel field effect transistor, and the driving transistor M12 and the sustain transistor M15 are shown as a p-channel field effect transistor. Alternatively, when the switching transistor M11 is provided as a p-channel field effect transistor, the sustain transistor M15 may be provided as an n-channel field effect transistor. The driving transistor M12 may be provided as an re-channel field effect transistor, and the compensation transistor M13 and the reset transistor M14 may be provided as a p-channel field effect transistor.

Additionally or alternatively, at least one of the switching transistor M11, the driving transistor M12, the compensation transistor M13, the reset transistor M14, the sustain transistor M15 may be an oxide thin film transistor (oxide TFT) in which the semiconductor layer may be made of an oxide semiconductor.

The oxide semiconductor may include any one of oxides based on titanium (Ti), hafnium (Hf), zirconium (Zr), aluminum (Al), tantalum (Ta), germanium (Ge), zinc (Zn), gallium (Ga), tin (Sn) or indium (In), and composite oxides thereof, e.g., a zinc oxide (ZnO), an indium-gallium-zinc oxide ($InGaZnO_4$), an indium-zinc oxide (In—Zn—O), a zinc-tin oxide (Zn—Sn—O) indium-gallium oxide (In—Ga—O), an indium-tin oxide (In—Sn—O), an indium-zirconium oxide (In—Zr—O), an indium-zirconium-zinc oxide (In—Zr—Zn—O), indium-zirconium-tin oxide (In—Zr—Sn—O), an indium-zirconium-gallium oxide (In—Zr—Ga—O), an indium-aluminum oxide (In—Al—O), an indium-zinc-aluminum oxide (In—Zn—Al—O), an indium-tin-aluminum oxide (In—Sn—Al—O), indium-aluminum-gallium oxide (In—Al—Ga—O), an indium-tantalum oxide (In—Ta—O), indium-tantalum-zinc oxide (In—Ta—Zn—O), an indium-tantalum-tin oxide (In—Ta—Sn—O), an indium-tantalum-gallium oxide (In—Ta—Ga—O), indium-germanium oxide (In—Ge—O), an indium-germanium-zinc oxide (In—Ge—Zn—O), indium-germanium-tin oxide (In—Ge—Sn—O), indium-germanium-gallium oxide (In—Ge—Ga—O), an titanium-indium-zinc oxide (Ti—In—Zn—O), and an hafnium-indium-zinc oxide (Hf—In—Zn—O).

The semiconductor layer includes a channel region non-doped with impurities, and a source region and drain region doped with impurities on both sides of the channel region. Here, these impurities vary depending on the type of the thin film transistor, and may be N type impurity or P type impurity.

When the semiconductor layer is made of the oxide semiconductor, an extra protection layer may be added in order to protect the oxide semiconductor vulnerable to the external environment such as being exposed to a high temperature.

Figure 4:
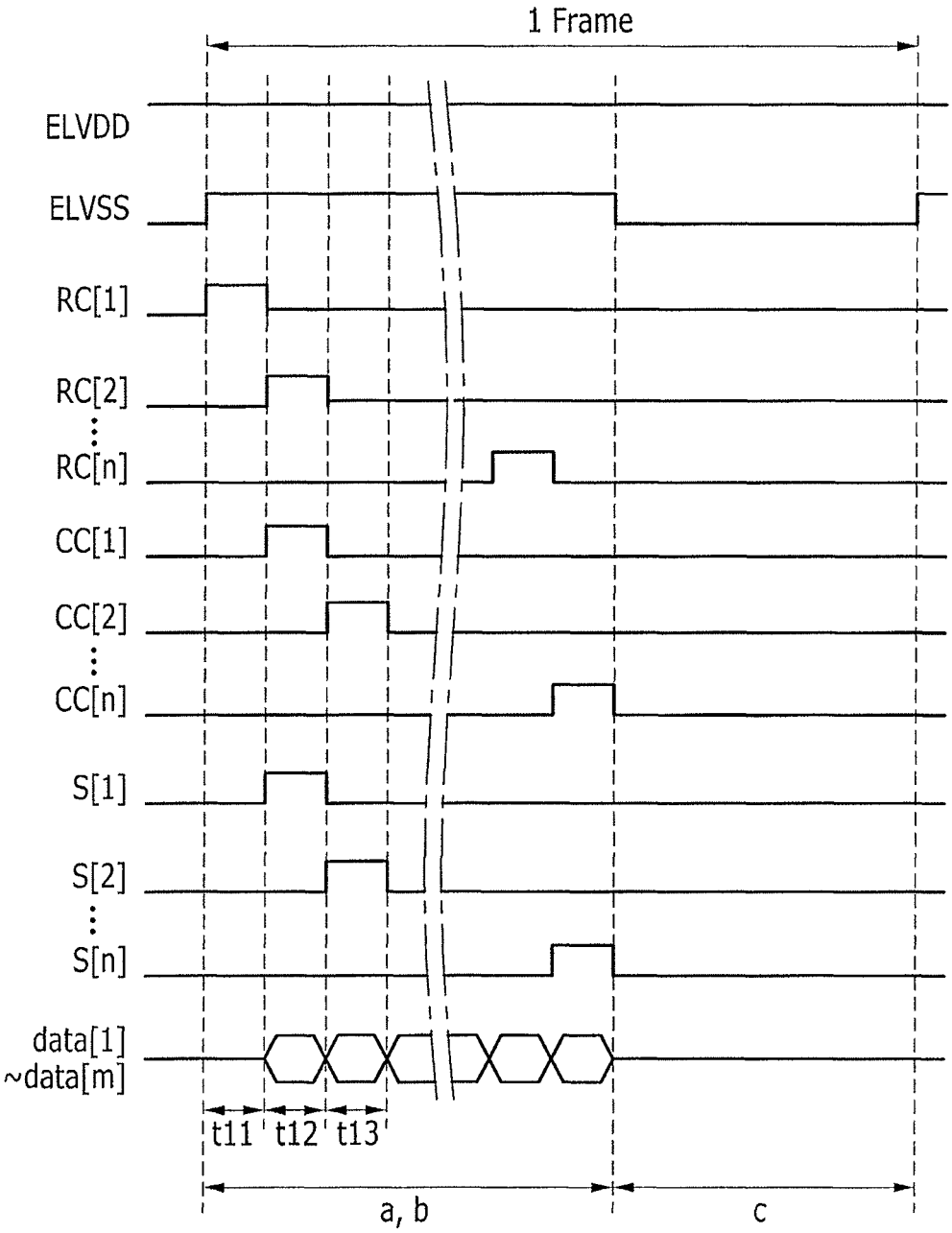
FIG. 4 illustrates a timing diagram of a driving method of a display device according to an exemplary embodiment.

FIG. 4 illustrates a timing diagram of a driving method of a display device according to an exemplary embodiment. A driving method of the display device 10 including a pixel 701 of FIG. 3 is shown.

Referring to FIGS. 1 to 4, the first power source voltage ELVDD is applied as a high level voltage during one frame. The second power source voltage ELVSS is applied as a high level voltage during the reset period (a) and threshold voltage compensation and scan period (b), and is applied as a low level voltage during the light emitting period (c).

During the reset period (a) and the threshold voltage compensation and scan period (b), the plurality of reset control signals RC[1]-RC[n] are sequentially applied to the plurality of reset control lines, the plurality of compensation control signals CC[1]-CC[n] are sequentially applied to the plurality of compensation control lines, and the plurality of scan signals S[1]-S[n] are sequentially applied to the plurality of scan lines.

As an example, during the reset period (a) and the threshold voltage compensation and scan period (b), an operation of the pixel arranged in the first scan line will be described.

During a period t11, the first reset control signal RC[1] is applied as a high level voltage and a reset transistor M14 is turned-on. As the reset transistor M14 is turned-on, the initializing voltage Vinit is transmitted to a second node N12. Accordingly, a voltage of the second node N12 may be the initializing voltage Vinit, and a gate voltage of the driving transistor M12 may be reset as the initializing voltage Vinit. At this time, the first compensation control signal CC[1] and the first scan signal S[1] are applied as a low level voltage. The compensation transistor M13 is turned-off by the first compensation control signal CC[1]. The switching transistor M11 is turned-off by the first scan signal S[1] and the sustain transistor M15 is turned-on. As the sustain transistor M15 is turned-on, the sustain voltage Vsus is transmitted to the first node N11.

During a period t12, the first reset control signal RC[1] is applied as a low level voltage, and the first compensation control signal CC[1] and the first scan signal S[1] are applied as a high level voltage. The reset transistor M14 is turned-off by the first reset control signal RC[1]. The compensation transistor M13 is turned-on by the first compensation control signal CC[1]. The switching transistor M11 is turned-on and the sustain transistor M15 is turned-off by the first scan signal S[1]. At this time, the plurality of data lines receives a plurality of data signals data[1]-data[m]. A data voltage Vdat is transmitted to the first node N11 and a voltage of the first node N11 may be Vdat, through the turned-on switching transistor M11. As the compensation transistor M13 is turned-on, the driving transistor M12 is diode-connected, and the gate voltage of the driving transistor M12, i.e., the voltage of the second node N12 is ELVDD+Vth. The storage capacitor C11 stores a voltage of EKVDD+Vth-Vdat. That is, as a threshold voltage Vth of the driving transistor M12 is stored in the storage capacitor C11, a threshold voltage Vth of the driving transistor M12 is compensated.

During a period t13, the first reset control signal RC[1], the first compensation control signal CC[1], and the first scan signal S[1] are applied as a low level voltage. Accordingly, the switching transistor M11, the compensation transistor M13, and the reset transistor M14 are turned-off, and the sustain transistor M15 is turned-on.

The sustain voltage Vsus is transmitted to the first node N11, a voltage of the first node N11 is varied as a sustain voltage Vsus, through the turned-on sustain transistor M15. A voltage of the second node N12 is varied by the amount of a voltage fluctuation (Vsus-Vdat) of the first node N11 due to a coupling of the storage capacitor C11 and the voltage of the second node N12 becomes ELVDD+Vth+Vsus-Vdat. That is, the voltage to which a data voltage Vdat is reflected may be applied to the gate electrode of the driving transistor M12.

The second reset control signal RC[2], the second compensation control signal CC[2], and the second scan signal S[2] are applied to a pixel arranged in the second scan line. The second reset control signal RC[2] is delayed by one duty from the first reset control signal RC[1] and applied to the pixel, the second compensation control signal CC[2] is delayed by one duty from the first compensation control signal CC[1] and applied to the pixel, and the second scan signal S[2] is delayed by one duty from the first scan signal S[1] and applied to the pixel. The one duty may be the same one horizontal cycle as one cycle of the horizontal synchronization signal Hsync and a data enable signal DE.

Accordingly, the pixel arranged to the second scan line is delayed by one duty from the pixel arranged to the first scan line than the pixel arranged to the first scan line to perform an operation according to the reset period (a) and the threshold voltage compensation and scan period (b). In this way, operation during the reset period (a) and threshold voltage compensation and scan period (b) is sequentially performed from the pixel arranged to the first scan line to the pixel arranged to the last scan line.

After the operation according to the reset period (a) and threshold voltage compensation and scan period (b) is sequentially completed from the pixel arranged to the first scan line to the pixel arranged to the last scan line, an operation according to the light emitting period (c) is performed.

During the light emitting period (c), the first power source voltage ELVDD maintains the high level voltage, and the second power source voltage ELVSS is varied to the low level voltage. The plurality of reset control signals RC[1]-RC[n], the plurality of compensation control signal CC[1]-CC[n], and the plurality of scan signal S[1]-S[n] are applied as a low level voltage. As the second power source voltage ELVSS is changed to the low level voltage, the current flows into the organic light emitting diode (OLED) through the driving transistor M12. The driving current (Ioled) flowed into the organic light emitting diode (OLED) is represented by the following equation 1.

$$\begin{aligned} Ioled &= k(Vgs - Vth)^2 \\ &= k((ELVVD + Vth + Vsus - Vdat) - ELVDD - Vth)^2 \\ &= k(Vsus - Vdat)^2 \end{aligned} \quad \text{(Equation 1)}$$

Where k is a parameter determined according to the characteristic of the driving transistor M12.

The organic light emitting diode (OLED) emit light having a brightness corresponding to the driving current (Ioled). In particular, the organic light emitting diode (OLED) emits light having a brightness corresponding to data voltage Vdat, without the deviation of a threshold voltage Vth of the driving transistor M12 and a voltage drop of the first power source voltage. The second power source voltage ELVSS is changed to a high level voltage at the point at which the light emitting period (c) ends.

Figure 5:
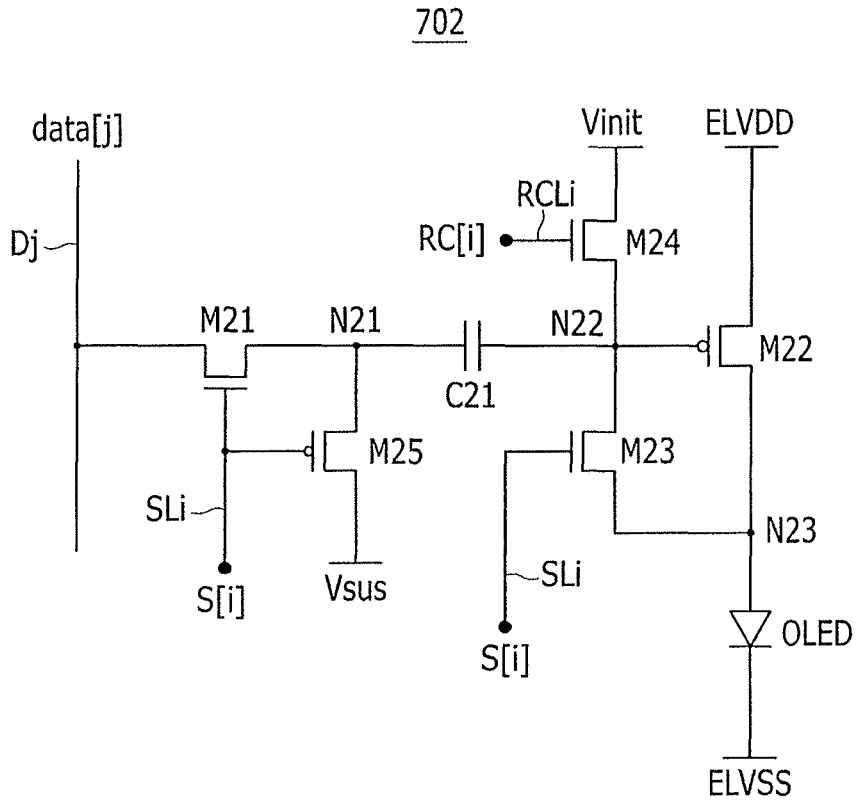
FIG. 5 illustrates a circuit diagram of a pixel according to another exemplary embodiment.

FIG. 5 illustrates a circuit diagram of a pixel 702 according to another exemplary embodiment. Referring to FIG. 5, the pixel 702 includes a switching transistor M21, a driving transistor M22, a compensation transistor M23, a reset transistor M24, a sustain transistor M25, a storage capacitor C21, and an organic light emitting diode (OLED).

In contrast with FIG. 3, a gate electrode of the compensation transistor M23 is connected to the scan line SLi, rather than the compensation control line. Thus, the compensation transistor M23 is turned on by the scan signal S[i] of the gate-on voltage applied to the scan line SLi to diode-connect the driving transistor M12. By connecting the gate electrode of the compensation transistor M23 to the scan line SLi, the compensation control signal unit 500 may be omitted in the display device 10 of FIG. 1. Since the constituent elements other than the compensation transistor M23 in the pixel 702 of FIG. 5 is the same as that of the constituent elements of the pixel of FIG. 3, a detailed description thereof will be omitted.

Figure 6:
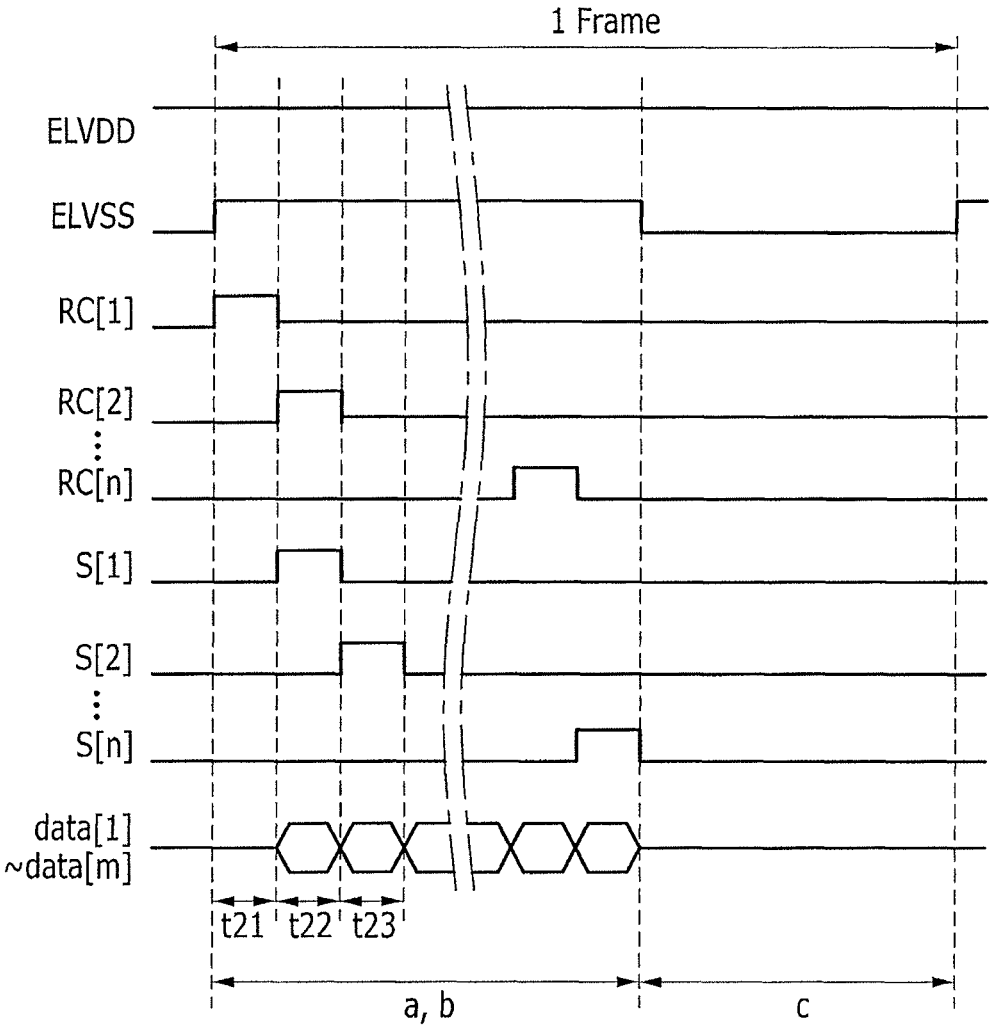
FIG. 6 illustrates a timing diagram of a driving method of a display device according to another exemplary embodiment.

FIG. 6 illustrates a timing diagram of a driving method of a display device according to another exemplary embodiment. The driving method of the display device 10 including the pixel 702 of FIG. 5 is shown. In comparison with FIG. 4, the plurality of compensation control signals CC[1]-CC[n] will be omitted.

During a period t21, the first reset control signal RC[1] is applied as a high level voltage and a first scan signal (S[1]) is applied as a low level voltage. Accordingly, the switching transistor M21 and the compensation transistor M23 are turned-off, and the reset transistor M24 and the sustain transistor M25 are turned-on. Similarly to the period t11 of FIG. 4, the gate voltage of the driving transistor M22 is reset as the initializing voltage Vinit.

During a period t22, the first reset control signal RC[1] is applied as a low level voltage, and a first scan signal S[1] is applied as a high level voltage. The reset transistor M24 is turned-off by the first reset control signal RC[1]. The compensation transistor M23 and the switching transistor M21 are turned-on by the first scan signal S[1], and the sustain transistor M25 is turned-off. The data voltage Vdat is transmitted to the first node N11, and the voltage of the first node N11 becomes Vdat through the turned-on switching transistor M21. As the compensation transistor M23 is turned-on, the driving transistor M22 is diode-connected, and the gate voltage of the driving transistor M22, i.e., the voltage of the second node N22 becomes ELVDD+Vth. Similar to the period t12 of FIG. 4, by storing the threshold voltage Vth of the driving transistor M22 in the storage capacitor C21, the threshold voltage Vth of the driving transistor M22 is compensated.

During a period t23, the first reset control signal RC[1] and the first scan signal S[1] are applied as a low level voltage. Accordingly, the switching transistor M21, the compensation transistor M23, and the reset transistor M24 are turned-off, and the sustain transistor M25 is turned-on. The sustain voltage Vsus is transmitted to the first node N21, and the voltage of the first node N21 is varied as the sustain voltage Vsus, the turned-on sustain transistor M25. A voltage of the second node N22 is varied by the amount of a voltage fluctuation (Vsus-Vdat) of the first node N21 due to a coupling of the storage capacitor C21 and the voltage of the second node N12 becomes ELVDD+Vth+Vsus-Vdat. Similarly to the period t13 of FIG. 4, a voltage to which data voltage Vdat is reflected to the gate electrode of the driving transistor M12 may be applied.

During the light emitting period (c), the first power source voltage ELVDD maintains the high level voltage, and the second power source voltage ELVSS is varied to the low level voltage, the plurality of reset control signals RC[1]-RC[n], and the plurality of scan signals (S[1]-S[n]) are applied as a low level voltage. Since the operation in the light emitting period (c) is the same as that in the light emitting period (c) of FIG. 4, a detailed description thereof will be omitted.

Figure 7:
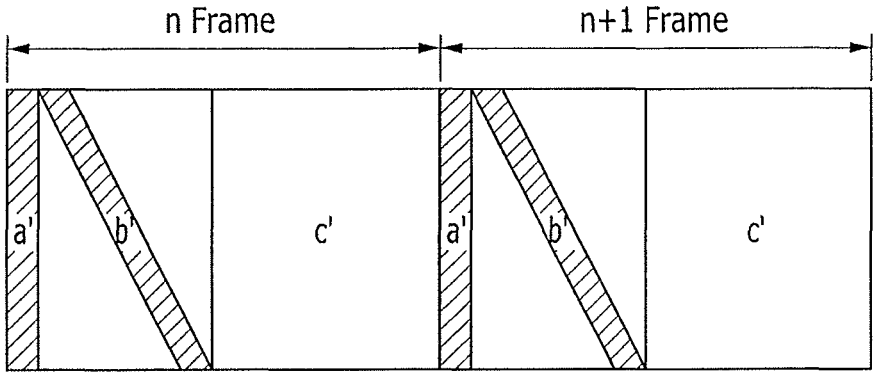
FIG. 7 illustrates a drawing of a driving operation of a simultaneous light emitting mode of a display device according to another exemplary embodiment.

FIG. 7 illustrates a drawing of a driving operation of a simultaneous light emitting mode of a display device according to another exemplary embodiment.

Referring to FIG. 7, a frame period in which one image is displayed the display 700 includes a reset period (a') to reset the driving voltage of the organic light emitting diode of the pixel, a threshold voltage compensation and scan period (b') in which a threshold voltage of the driving transistor of the pixel is compensated, and the data signal is transmitted to each of the plurality of pixels, and a light emitting period (c') in which the plurality of pixels emit light in response to the transmitted data signal.

The operation in the threshold voltage compensation and scan period (b') is sequentially performed for each scan line, and the operation in the reset period (a') and the light emitting period (c') is performed in the entire of the display 700 simultaneously. In contrast with the sequential light emitting mode of FIG. 2, the reset period (a') is simultaneous for all scan lines of the whole of the display 700.

Figure 8:
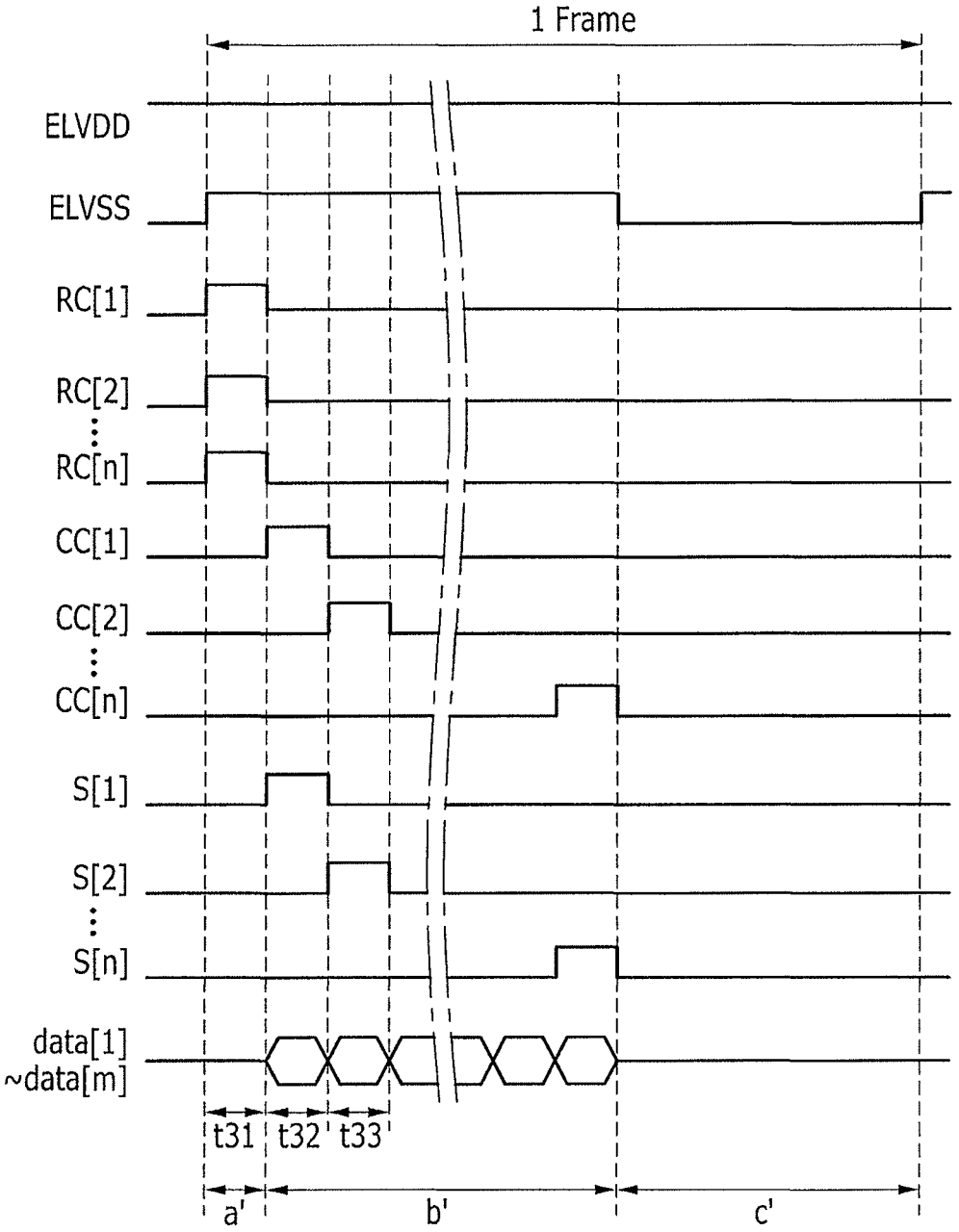
FIG. 8 illustrates a timing diagram of a driving method of a display device according to yet another exemplary embodiment.

FIG. 8 illustrates a timing diagram of a driving method of a display device according to yet another exemplary embodiment. A case where the display device 10 including the pixel 701 of FIG. 3 is driven by a simultaneous light emitting mode of FIG. 7 is shown.

In comparison with the driving method of FIG. 4, the plurality of reset control signals RC[1]-RC[n] is applied as a high level voltage in a period t31 simultaneously. Accordingly, an operation in which a gate voltage of the driving transistor M12 is reset as the initializing voltage Vinit may be simultaneously performed in the plurality of pixels. That is, the operation in the reset period (a') is performed in the entire of the display 700 simultaneously.

Since the operations in the period t32, the period t33 and the light emitting period (c') are the same as those of the period t12, the period t13, and the light emitting period (c) of FIG. 4, the detailed description thereof will be omitted.

Figure 9:
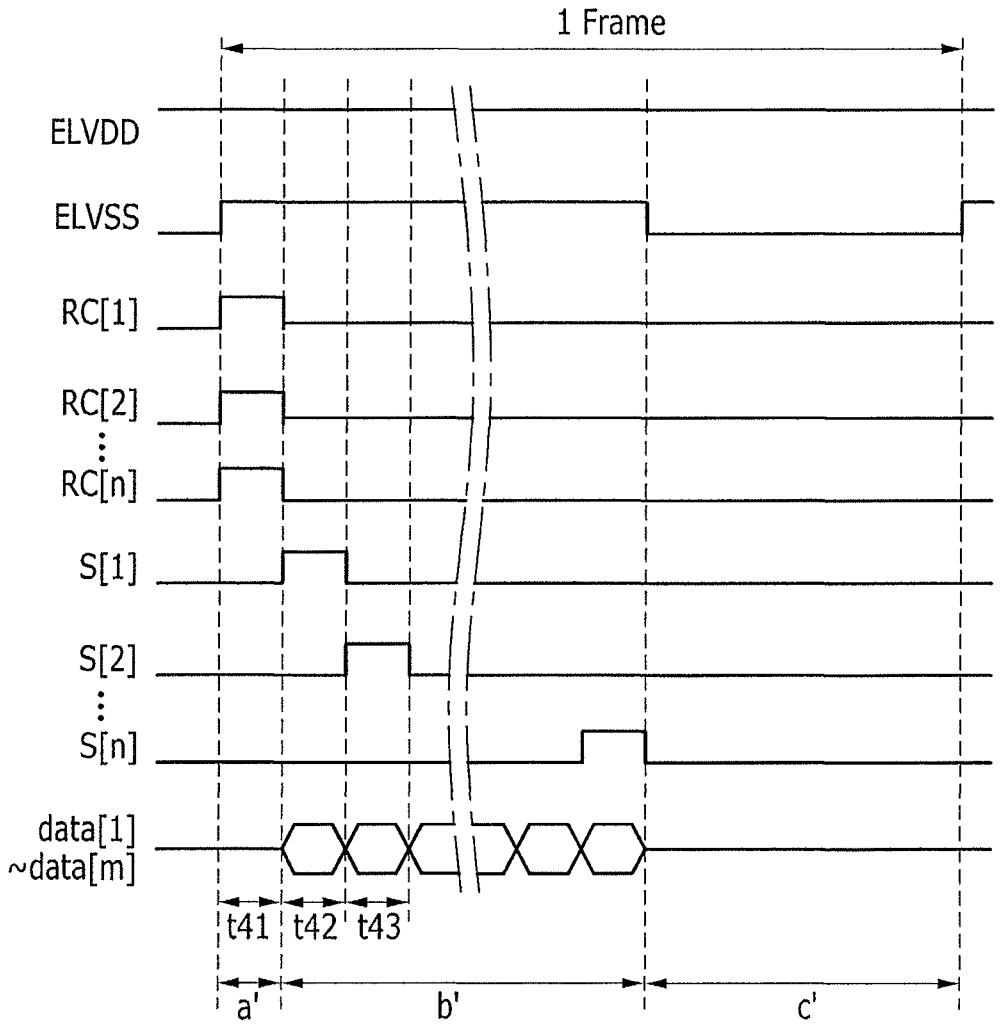
FIG. 9 illustrates a timing diagram of a driving method of a display device according to yet another exemplary embodiment.

FIG. 9 illustrates a timing diagram illustrating a driving method of a display device according to yet another exemplary embodiment. A case where the display device 10 including the pixel 702 of FIG. 5 is driven in the simultaneous light emitting mode of FIG. 7 is shown.

In comparison with the driving method of FIG. 6, the plurality of reset control signals RC[1]-RC[n] are simultaneously applied as high level voltage in the period t41. Accordingly, an operation in which a gate voltage of the driving transistor M22 is reset as the initializing voltage Vinit may be simultaneously performed in the plurality of pixels. That is, the operation in the reset period (a') is performed in the entire of the display 700 simultaneously.

Since the operations in a period t42, a period t43, and a light emitting period (c') are the same as those of the period t22, the period t23, and the light emitting period (c) of FIG. 6, the detailed description thereof will be omitted.

As described above, since the proposed pixels 701 and 702 are made of a simple configuration including five transistors and one capacitor, the aperture ratio and the yield in the production process of the display device can be improved. In addition, the proposed pixels 701 and 702 may perform the driving operation of the simultaneous light emitting mode, and accordingly, the display device can be driven at a high speed.

Thus, one or more embodiments provide a pixel, a display device including the same, and a driving method thereof in which the display device can be driven at high speed and the aperture ratio can be increased. Since the proposed pixels and are made of a simple configuration including five transistors and one capacitor, the aperture ratio and the production yield can be improved. In addition, the proposed pixels may perform the driving operation of the simultaneous light emitting mode, and accordingly, the display device can be driven at a high speed.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A pixel, comprising:

a switching transistor including a gate electrode connected to a scan line, a first electrode connected to a data line, and a second electrode connected to a first node;

a sustain transistor including a gate electrode connected to the scan line, a first electrode connected to a sustain voltage, and a second electrode connected to the first node;

a storage capacitor including a first electrode connected to the first node and a second electrode connected to a second node;

a driving transistor including a gate electrode connected to the second node, a first electrode connected to a first power source voltage, and a second electrode connected to a third node;

a compensation transistor including a gate electrode connected to the scan line, a first electrode connected to the second node, and a second electrode connected to the third node;

a reset transistor including a gate electrode connected to a reset control line, a first electrode connected to an initializing voltage, and a second electrode connected to the second node; and an organic light emitting diode including an anode connected to the third node, and a cathode connected to a second power source voltage, wherein:

the sustain transistor and the reset transistor are turned on during a first period, the switching transistor and the compensation transistor are turned on during a second period which does not overlap the first period, and the sustain transistor is turned on during a third period between the second period and a light emitting period.

2. The pixel as claimed in claim 1, wherein the switching transistor is an n-channel field effect transistor and the sustain transistor is a p-channel field effect transistor.

3. The pixel as claimed in claim 1, wherein the driving transistor is a p-channel field effect transistor and the compensation transistor and the reset transistor are n-channel field effect transistors.

4. The pixel as claimed in claim 1, wherein at least one of the switching transistor, the sustain transistor, the driving transistor, the compensation transistor, and the reset transistor is an oxide thin film transistor.

5. The pixel as claimed in claim 1, wherein a turn-on period of the compensation transistor does not overlap a turn-on period of the reset transistor.

6. A display device, comprising:

a plurality of pixels;

a scan driver to apply a scan signal to a plurality of scan lines connected to the plurality of pixels;

a data driver to apply a data signal to a plurality of data lines connected to the plurality of pixels in response to the scan signal; and a power supply unit to supply a first power source voltage, a second power source voltage, a sustain voltage and an initializing voltage to the plurality of pixels and to control a light emitting of the plurality of pixels by changing the second power source voltage, wherein each of the plurality of pixels includes:

a switching transistor including a gate electrode connected to a respective scan line, a first electrode connected to a respective data line, and a second electrode connected to a first node;

a sustain transistor including a gate electrode connected to the respective scan line, a first electrode connected to the sustain voltage, and a second electrode connected to the first node;

a storage capacitor including a first electrode connected to the first node and a second electrode connected to a second node;

a driving transistor including a gate electrode connected to the second node, a first electrode connected to the first power source voltage, and a second electrode connected to a third node;

a compensation transistor including a gate electrode connected to the respective scan line connected to the plurality of pixels, a first electrode connected to the second node, and a second electrode connected to the third node;

a reset transistor including a gate electrode connected to a respective reset control line connected to the plurality of pixels, a first electrode connected to the initializing voltage, and a second electrode connected to the second node; and an organic light emitting diode including an anode connected to the third node and a cathode connected to the second power source voltage, and wherein:

the sustain transistor and the reset transistor are turned on during a first period, the switching transistor and the compensation transistor are turned on during a second period which does not overlap the first period, and the sustain transistor is turned on during a third period between the second period and a light emitting period.

7. The display device as claimed in claim 6, wherein the switching transistor is an n-channel field effect transistor and the sustain transistor is a p-channel field effect transistor.

8. The display device as claimed in claim 7, wherein the driving transistor is a p-channel field effect transistor, and the compensation transistor and the reset transistor are n-channel field effect transistors.

9. The display device as claimed in claim 6, wherein:

at least one of the switching transistor, the sustain transistor, the driving transistor, the compensation transistor, and the reset transistor is an oxide thin film transistor.

10. A driving method of a display device that includes a plurality of pixels including a first node to which a data voltage is applied through a switching transistor turned-on by a scan signal of a gate-on voltage and to which a sustain voltage is applied through a sustain transistor turned on by a scan signal of a gate off voltage, a second node connected to a gate electrode of a driving transistor that controls a driving current transmitted to an organic light emitting diode from a first power source voltage, and a storage capacitor connected between the first node and the second node, the driving method comprising:

applying a reset control signal of a gate-on voltage to a gate electrode of a reset transistor that transmits an initializing voltage to the second node such that a voltage of the second node is reset to the initializing voltage;

applying a scan signal of the gate-on voltage to a plurality of scan lines connected to the plurality of pixels and turning on a compensation transistor by the scan signal of the gate-on voltage that diode-connects the driving transistor such that a threshold voltage of the driving transistor is compensated;

turning on the switching transistor by a scan signal of the gate-on voltage such that the data voltage is applied to the first node;

turning on the sustain transistor by a scan signal of the gate off voltage such that a voltage of the first node is changed from the data voltage to the sustain voltage;

applying a voltage to which the data voltage is reflected through a coupling by the storage capacitor; and changing a second power source voltage connected to a cathode of the organic light emitting diode and turning on the driving transistor according to a voltage of the second node to which the data voltage is reflected such that the organic light emitting diode emits light, wherein:

the sustain transistor and the reset transistor are turned on during a first period, the switching transistor and the compensation transistor are turned on during a second period which does not overlap the first period, and the sustain transistor is turned on during a third period between the second period and a light emitting period.

11. The driving method as claimed in claim 10, wherein compensating the threshold voltage of the driving transistor and applying the data voltage to the first node are performed at the same time.

12. The driving method as claimed in claim 10, wherein resetting the voltage of the second node to the initializing voltage includes:

sequentially applying a reset control signal of the gate-on voltage to a plurality of reset control lines connected to the plurality of pixels.

13. The driving method as claimed in claim 10, wherein resetting the voltage of the second node to the initializing voltage includes:

applying a reset control signal of the gate-on voltage to a plurality of reset control lines connected to the plurality of pixels at the same time.

* * * * *